US011435119B2

(12) United States Patent
Matsuda

(10) Patent No.: US 11,435,119 B2
(45) Date of Patent: Sep. 6, 2022

(54) REFRIGERATION CYCLE APPARATUS

(71) Applicant: Mitsubishi Electric Corporation, Tokyo (JP)

(72) Inventor: Takuya Matsuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 86 days.

(21) Appl. No.: 16/976,813

(22) PCT Filed: May 10, 2018

(86) PCT No.: PCT/JP2018/018168

§ 371 (c)(1),
(2) Date: Aug. 31, 2020

(87) PCT Pub. No.: WO2019/215881

PCT Pub. Date: Nov. 14, 2019

(65) Prior Publication Data

US 2020/0400350 A1 Dec. 24, 2020

(51) Int. Cl.
*F25B 13/00* (2006.01)

(52) U.S. Cl.
CPC ..... *F25B 13/00* (2013.01); *F25B 2313/0233* (2013.01); *F25B 2313/0253* (2013.01);
(Continued)

(58) Field of Classification Search
CPC ..... F25B 13/00; F25B 2313/006; F25B 2313/0231; F25B 2313/0233;
(Continued)

(56) References Cited

U.S. PATENT DOCUMENTS

2003/0177775 A1 9/2003 Wanami et al.
2010/0282434 A1* 11/2010 Yabuuchi ..... F25B 13/00 62/238.7

(Continued)

FOREIGN PATENT DOCUMENTS

EP 3514462 A1 7/2019
EP 3517853 A1 7/2019

(Continued)

OTHER PUBLICATIONS

Office Action dated Jun. 1, 2021, issued in corresponding JP Patent Application No. 2020-517709 (and English Machine Translation).

(Continued)

*Primary Examiner* — Henry T Crenshaw
(74) *Attorney, Agent, or Firm* — Posz Law Group, PLC

(57) ABSTRACT

A refrigeration cycle apparatus includes a compressor, a four-way valve, a second flow path switching unit, a first outdoor heat exchanger, a second outdoor heat exchanger, a first indoor heat exchanger and a second flow path switching unit. The second flow path switching unit switches between a third state in which the first port, the second port, the first outdoor heat exchanger, the fourth port, the third port, the second heat exchanger, the fifth port and the sixth port are successively connected in series, and a fourth state in which the sixth port, the fourth port, the first heat exchanger, the second port and the first port are successively connected in series, and the sixth port, the fifth port, the second heat exchanger, the third port and the first port are successively connected in series.

4 Claims, 10 Drawing Sheets

(52) U.S. Cl.
CPC ..... *F25B 2313/0292* (2013.01); *F25B 2313/02741* (2013.01); *F25B 2600/2519* (2013.01)

(58) Field of Classification Search
CPC ..... F25B 2313/0234; F25B 2313/0253; F25B 2600/2519; F25B 41/24; F25B 2313/02741; F25B 2313/0292
See application file for complete search history.

(56) References Cited

U.S. PATENT DOCUMENTS

| | | | | |
|---|---|---|---|---|
| 2012/0118533 | A1 | 5/2012 | Jang et al. | |
| 2016/0245540 | A1* | 8/2016 | Koge | F24F 3/06 |
| 2019/0162454 | A1* | 5/2019 | Hatomura | F25B 5/02 |

FOREIGN PATENT DOCUMENTS

| | | | |
|---|---|---|---|
| JP | 2003-276427 | A | 9/2003 |
| JP | 2012-077921 | A | 4/2012 |
| JP | 2015-117936 | A | 6/2015 |
| JP | 2018-054196 | A | 4/2018 |
| WO | 2016/001957 | A1 | 1/2016 |
| WO | 2018/047330 | A1 | 3/2018 |
| WO | 2018/051408 | A1 | 3/2018 |
| WO | 2018/055741 | A1 | 3/2018 |

OTHER PUBLICATIONS

International Search Report of the International Searching Authority dated Jul. 31, 2018 for the corresponding International application No. PCT/JP2018/018168 (and English translation).
Extended European Search Report dated Apr. 15, 2021, issued in corresponding European Patent Application No. 18918248.8.

* cited by examiner

REFRIGERATION CYCLE APPARATUS

CROSS REFERENCE TO RELATED APPLICATION

This application is a U.S. national stage application of International Application PCT/JP2018/018168 filed on May 10, 2018, the contents of which are incorporated herein by reference.

TECHNICAL FIELD

The present invention relates to a refrigeration cycle apparatus.

BACKGROUND

Japanese Patent Laying-Open No. 2015-117936 discloses an air conditioner including an outdoor heat exchanger that is divided into a plurality of unit flow paths, in which at least two of the plurality of unit flow paths are connected to each other in series during cooling operation and connected to each other in parallel during heating operation. The above-mentioned air conditioner has improved heat exchange efficiency by proper selection and use of the number and the length of the unit flow paths in the cooling operation and the heating operation.

PATENT LITERATURE

PTL 1: Japanese Patent Laying-Open No. 2015-117936

The above-mentioned air conditioner, however, requires a plurality of pipes to connect a check valve and a solenoid valve to each of the plurality of unit flow paths. Routing of these plurality of pipes is also complicated in the above-mentioned air conditioner. The above-mentioned air conditioner thus requires a large space to install the plurality of pipes, making downsizing difficult. The above-mentioned air conditioner also requires a large number of processing steps for connection of each the plurality of pipes, thus increasing manufacturing cost.

Further, if the above-mentioned air conditioner has varying specifications of the outdoor heat exchanger such as the number of the plurality of unit flow paths depending on the horsepower of the air conditioner, whether or not the air conditioner delivers high performance, and the like, it is required to redesign the pipes and routing thereof.

SUMMARY

A main object of the present invention is to provide a refrigeration cycle apparatus which has simplified routing of pipes compared to the above-mentioned air conditioner, and which eliminates the need to redesign the routing of pipes for each specification of an outdoor heat exchanger.

A refrigeration cycle apparatus according to the present invention includes a refrigerant circuit through which refrigerant circulates. The refrigerant circuit includes a compressor, a first flow path switching unit, a second flow path switching unit, a first heat exchanger, a second heat exchanger, and a third heat exchanger. The first heat exchanger has a first flow-in/out portion and a second flow-in/out portion to/from which the refrigerant flows in/out. The second heat exchanger has a third flow-in/out portion and a fourth flow-in/out portion to/from which the refrigerant flows in/out. The first flow path switching unit is configured to switch between a first state and a second state.

In the first state, at least one of the first heat exchanger and the second heat exchanger is configured to serve as a condenser while the third heat exchanger is configured to serve as an evaporator. In the second state, at least one of the first heat exchanger and the second heat exchanger is configured to serve as an evaporator while the third heat exchanger is configured to serve as a condenser. The second flow path switching unit has a first port, a second port, a third port, a fourth port, a fifth port, and a sixth port through which the refrigerant flows in/out. The first port is connected to a discharge port of the compressor via the first flow path switching unit in the first state, and is connected to a suction port of the compressor via the first flow path switching unit in the second state. The second port is connected to the first flow-in/out portion. The third port is connected to the third flow-in/out portion. The fourth port is connected to the second flow-in/out portion. The fifth port is connected to the fourth flow-in/out portion. The sixth port is connected to the third heat exchanger. The second flow path switching unit is configured to switch between a third state and a fourth state. In the third state, the first port, the second port, the first heat exchanger, the fourth port, the third port, the second heat exchanger, the fifth port and the sixth port are successively connected in series. In the fourth state, the sixth port, the fourth port, the first heat exchanger, the second port and the first port are successively connected in series, and the sixth port, the fifth port, the second heat exchanger, the third port and the first port are successively connected in series.

In the refrigeration cycle apparatus according to the present invention, switching between the third state in which a first outdoor heat exchanger and a second outdoor heat exchanger are connected in series and the fourth state in which they are connected in parallel is implemented in the second flow path switching unit. According to the present invention, therefore, a refrigeration cycle apparatus which has simplified routing of pipes outside the second flow path switching unit compared to the above-mentioned air conditioner, and which eliminates the need to redesign the routing of pipes for each specification of the outdoor heat exchangers can be provided.

DETAILED DESCRIPTION

Figure 1:
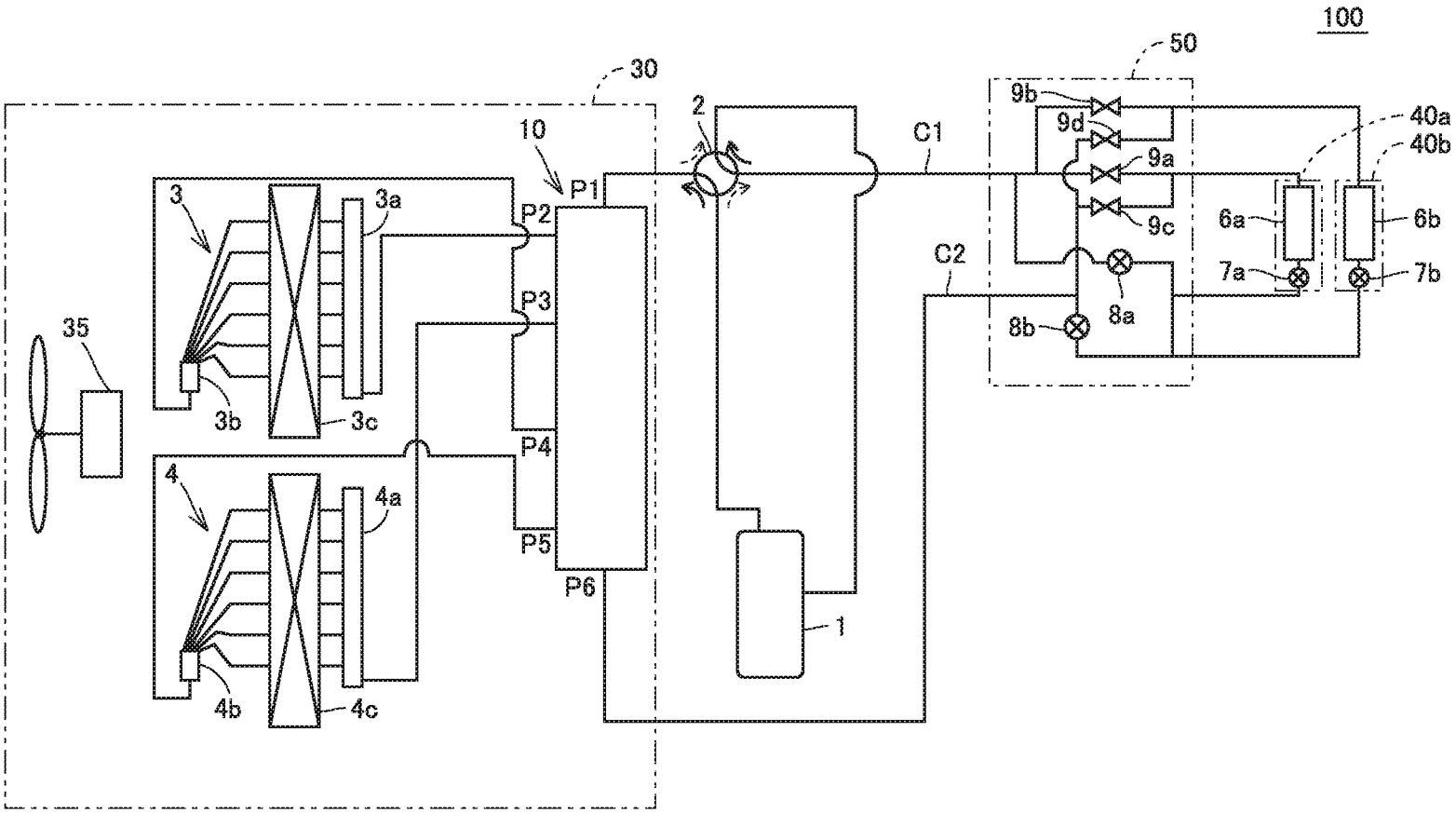
FIG. 1 illustrates a refrigeration cycle apparatus according to a first embodiment.

Embodiments of the present invention will be described hereinafter in detail with reference to the drawings. The same or corresponding parts in the drawings are designated by the same characters and description thereof will not be repeated in principle.

First Embodiment

As shown in FIG. 1, a refrigeration cycle apparatus 100 according to a first embodiment includes a compressor 1, a four-way valve 2 as a first flow path switching unit, a first outdoor heat exchanger 3 as a first heat exchange unit, a second outdoor heat exchanger 4 as a second heat exchange unit, a first indoor heat exchanger 6*a* and a second indoor heat exchanger 6*b* as a third heat exchange unit, a first decompression unit 7*a*, a second decompression unit 7*b*, a third decompression unit 8*a*, a fourth decompression unit 8*b*, on-off valves 9*a*, 9*b*, 9*c*, 9*d*, and a second flow path switching unit 10, to form a refrigerant circuit through which refrigerant circulates.

From a different viewpoint, refrigeration cycle apparatus 100 includes an outdoor unit 30, a first indoor unit 40*a*, a second indoor unit 40*b*, and a relay unit 50. In outdoor unit 30, there are disposed first circuitry of the refrigerant circuit including compressor 1, four-way valve 2, first outdoor heat exchanger 3, second outdoor heat exchanger 4 and second flow path switching unit 10, and an outdoor fan 35. In first indoor unit 40*a*, there are disposed second circuitry of the refrigerant circuit including first indoor heat exchanger 6*a* and first decompression unit 7*a*, and an indoor fan (not shown). In second indoor unit 40*b*, there are disposed third circuitry of the refrigerant circuit including second indoor heat exchanger 6*b* and second decompression unit 7*b*, and an indoor fan (not shown). In relay unit 50, there is disposed fourth circuitry of the refrigerant circuit including third decompression unit 8*a*, fourth decompression unit 8*b* and the plurality of on-off valves 9*a*, 9*b*, 9*c*, 9*d*.

The first circuitry of the refrigerant circuit disposed in outdoor unit 30 and the fourth circuitry of the refrigerant circuit disposed in relay unit 50 are connected to each other via a first pipe C1 and a second pipe C2. The fourth circuitry of the refrigerant circuit disposed in relay unit 50 and the second circuitry of the refrigerant circuit disposed in first indoor unit 40*a* are connected to each other via the two pipes. The fourth circuitry of the refrigerant circuit disposed in relay unit 50 and the third circuitry of the refrigerant circuit disposed in second indoor unit 40*b* are connected to each other via the two pipes. The second circuitry and the third circuitry of the refrigerant circuit are connected in parallel with the fourth circuitry.

Compressor 1 has a discharge port through which the refrigerant is discharged, and a suction port through which the refrigerant is sucked.

Four-way valve 2 has a first opening connected to the discharge port of compressor 1 via a discharge pipe, a second opening connected to the suction port of compressor 1 via a suction pipe, a third opening connected to first pipe C1, and a fourth opening connected to second pipe C2 via second flow path switching unit 10. The fourth opening in four-way valve 2 is connected to a first port P1 of second flow path switching unit 10. Four-way valve 2 switches between a first state in which each of first outdoor heat exchanger 3 and second outdoor heat exchanger 4 serves as a condenser while the third heat exchange unit serves as an evaporator, and a second state in which each of first outdoor heat exchanger 3 and second outdoor heat exchanger 4 serves as an evaporator while the third heat exchange unit serves as a condenser. Solid line arrows shown in FIG. 1 indicate a flow direction of the refrigerant circulating through the refrigerant circuit when refrigeration cycle apparatus 100 is in the first state. Dotted line arrows shown in FIG. 1 indicate a flow direction of the refrigerant circulating through the refrigerant circuit when refrigeration cycle apparatus 100 is in the second state.

First outdoor heat exchanger 3 includes a first distribution unit 3*a* as a first flow-in/out portion and a second distribution unit 3*b* as a second flow-in/out portion to/from which the refrigerant flows in/out, and a first heat exchange unit 3*c* disposed between first distribution unit 3*a* and second distribution unit 3*b*. First heat exchange unit 3*c* has a plurality of heat transfer tubes and a plurality of fins, for example. First distribution unit 3*a* is connected to one end of each of the plurality of heat transfer tubes. Second distribution unit 3*b* is connected to the other end of each of the plurality of heat transfer tubes.

Second outdoor heat exchanger 4 includes a third distribution unit 4*a* as a third flow-in/out portion and a fourth distribution unit 4*b* as a fourth flow-in/out portion to/from which the refrigerant flows in/out, and a second heat exchange unit 4*c* disposed between third distribution unit 4*a* and fourth distribution unit 4*b*. Second heat exchange unit 4*c* has a plurality of heat transfer tubes and a plurality of fins, for example. Third distribution unit 4*a* is connected to one end of each of the plurality of heat transfer tubes. Fourth distribution unit 4*b* is connected to the other end of each of the plurality of heat transfer tubes.

First outdoor heat exchanger 3 may have a capacity equal to or different from that of second outdoor heat exchanger 4. First outdoor heat exchanger 3 may have a capacity greater than or smaller than that of second outdoor heat exchanger 4.

In the first state and the second state, first distribution unit 3*a* is disposed on a gas refrigerant side of first outdoor heat exchanger 3, and second distribution unit 3*b* is disposed on a liquid refrigerant side of first outdoor heat exchanger 3. In the first state and the second state, third distribution unit 4*a* is disposed on a gas refrigerant side of second outdoor heat exchanger 4, and fourth distribution unit 4*b* is disposed on a liquid refrigerant side of second outdoor heat exchanger 4. The liquid refrigerant side of a heat exchanger means a side from which liquid refrigerant flows out when the heat exchanger serves as a condenser, and to which liquid refrigerant flows in when the heat exchanger serves as an evaporator. The liquid refrigerant means liquid single-phase refrigerant or gas-liquid two-phase refrigerant, which includes a high amount of liquid-phase refrigerant. The gas refrigerant side of a heat exchanger, on the other hand, means a side to which gas refrigerant flows in when the heat exchanger serves as a condenser, and from which gas refrigerant flows out when the heat exchanger serves as an evaporator. The gas refrigerant means gas single-phase refrigerant.

Second flow path switching unit 10 has first port P1, a second port P2, a third port P3, a fourth port P4, a fifth port P5, and a sixth port P6 through which the refrigerant flows in/out. Second flow path switching unit 10 is configured as a single unit.

As described above, first port P1 is connected to the fourth opening in four-way valve 2. First port P1 is thereby connected to the discharge port of compressor 1 via four-way valve 2 in the first state, and connected to the suction port of compressor 1 via four-way valve 2 in the second state. Second port P2 is connected to first distribution unit 3*a*. Third port P3 is connected to third distribution unit 4*a*. Fourth port P4 is connected to second distribution unit 3*b*. Fifth port P5 is connected to fourth distribution unit 4*b*. Sixth port P6 is connected to second pipe C2. Sixth port P6 is connected to first indoor heat exchanger 6*a* and second indoor heat exchanger 6*b* via second pipe C2 and relay unit 50.

As shown in FIGS. 2 to 6, second flow path switching unit 10 switches among a third state, a fifth state, a sixth state and a fourth state. In the third state shown in FIGS. 2 (A) and 3, first port P1, second port P2, fourth port P4, third port P3, fifth port P5 and sixth port P6 are successively connected in series. In the fourth state shown in FIGS. 2 (B) and 4, fourth port P4 and fifth port P5 are connected in parallel with sixth port P6, and second port P2 and third port P3 are connected in parallel with first port P1. In other words, in the fourth state, sixth port P6, fourth port P4, first outdoor heat exchanger 3, second port P2 and first port P1 are successively connected in series, and sixth port P6, fifth port P5, second outdoor heat exchanger 4, third port P3 and first port P1 are successively connected in series. In the fifth state shown in FIGS. 2 (C) and 5, first port P1, second port P2, fourth port P4 and sixth port P6 are successively connected in series. In the sixth state shown in FIGS. 2 (D) and 6, first port P1, third port P3, fifth port P5 and sixth port P6 are successively connected in series.

Figure 2:
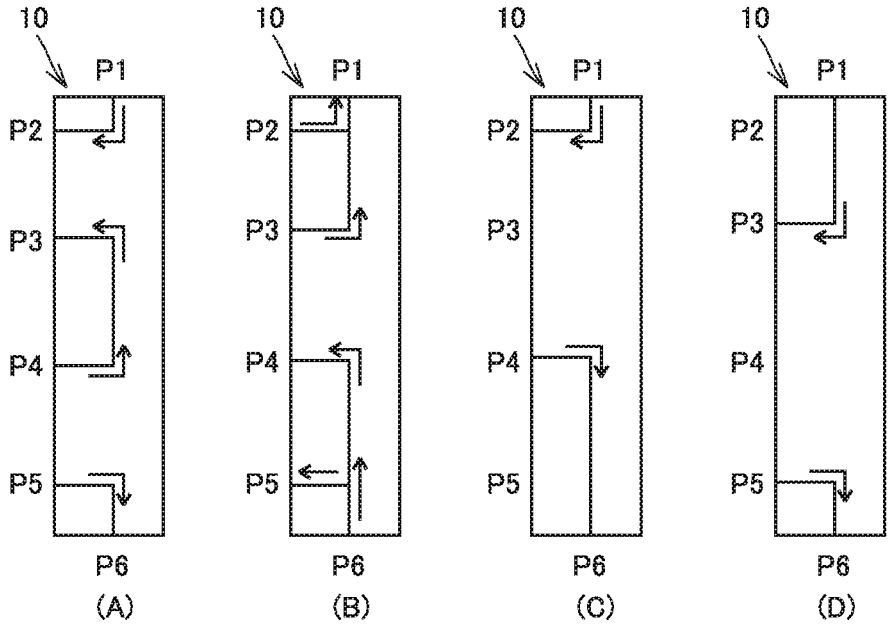
FIG. 2 shows a diagram (A) illustrating a refrigerant flow path in a second flow path switching unit shown in FIG. 1 when the second flow path switching unit is in a third state, a diagram (B) illustrating a refrigerant flow path in the second flow path switching unit shown in FIG. 1 when the second flow path switching unit is in a fourth state, a diagram (C) illustrating a refrigerant flow path in the second flow path switching unit shown in FIG. 1 when the second flow path switching unit is in a fifth state, and a diagram (D) illustrating a refrigerant flow path in the second flow path switching unit shown in FIG. 1 when the second flow path switching unit is in a sixth state.

From a different viewpoint, as shown in FIG. 2 (A), second flow path switching unit 10 has, in the third state, a first flow path connecting first port P1 to second port P2, a second flow path connecting fourth port P4 to third port P3, and a third flow path connecting fifth port P5 to sixth port P6. As shown in FIG. 2 (B), second flow path switching unit 10 has, in the fourth state, the first flow path, a fifth flow path, the third flow path, and a fourth flow path. As shown in FIG. 2 (C), second flow path switching unit 10 has, in the fifth state, the first flow path, and the fourth flow path connecting fourth port P4 to sixth port P6. As shown in FIG. 2 (D), second flow path switching unit 10 has, in the sixth state, the fifth flow path connecting first port P1 to third port P3, and the third flow path. Arrows shown in FIGS. 2 (A) to (D) indicate flow directions of the refrigerant in the respective states.

One of the third state, the fifth state and the sixth state is selected depending on the cooling load when the refrigeration cycle apparatus is in the first state. The fourth state is selected when the refrigeration cycle apparatus is in the second state.

Second flow path switching unit 10 may have any configuration so long as it is able to switch among the third state, the fifth state, the sixth state and the fourth state. One configuration example of second flow path switching unit 10 is described below.

As shown in FIGS. 3 to 7, second flow path switching unit 10 includes a first pipe path connecting first port P1 to sixth port P6, and a second pipe path, a third pipe path, a fourth pipe path and a fifth pipe path that are successively connected to the first pipe path in a direction in which the first pipe path extends from first port P1 toward sixth port P6. The first pipe path extends linearly, for example.

The second pipe path connects second port P2 to the first pipe path. The third pipe path connects third port P3 to the first pipe path. The fourth pipe path connects fourth port P4 to the first pipe path. The fifth pipe path connects fifth port P5 to the first pipe path. A connection portion between the first pipe path and the second pipe path is defined as a first connection portion, a connection portion between the first pipe path and the third pipe path is defined as a second connection portion, a connection portion between the first pipe path and the fourth pipe path is defined as a third connection portion, and a connection portion between the first pipe path and the fifth pipe path is defined as a fourth connection portion.

As shown in FIGS. 3 to 7, second flow path switching unit 10 further includes, for example, a first on-off valve 11, a second on-off valve 12, a third on-off valve 13, a fourth on-off valve 14, a fifth on-off valve 15, a sixth on-off valve 16, and a seventh on-off valve 17. First on-off valve 11 opens and closes the second pipe path. Second on-off valve 12 opens and closes the third pipe path. Third on-off valve 13 opens and closes the fourth pipe path. Fourth on-off valve 14 opens and closes the fifth pipe path. Fifth on-off valve 15 opens and closes a portion located between the first connection portion and the second connection portion in the first pipe path. Sixth on-off valve 16 opens and closes a portion located between the second connection portion and the third connection portion in the first pipe path. Seventh on-off valve 17 opens and closes a portion located between the third connection portion and the fourth connection portion in the first pipe path.

Figure 3:
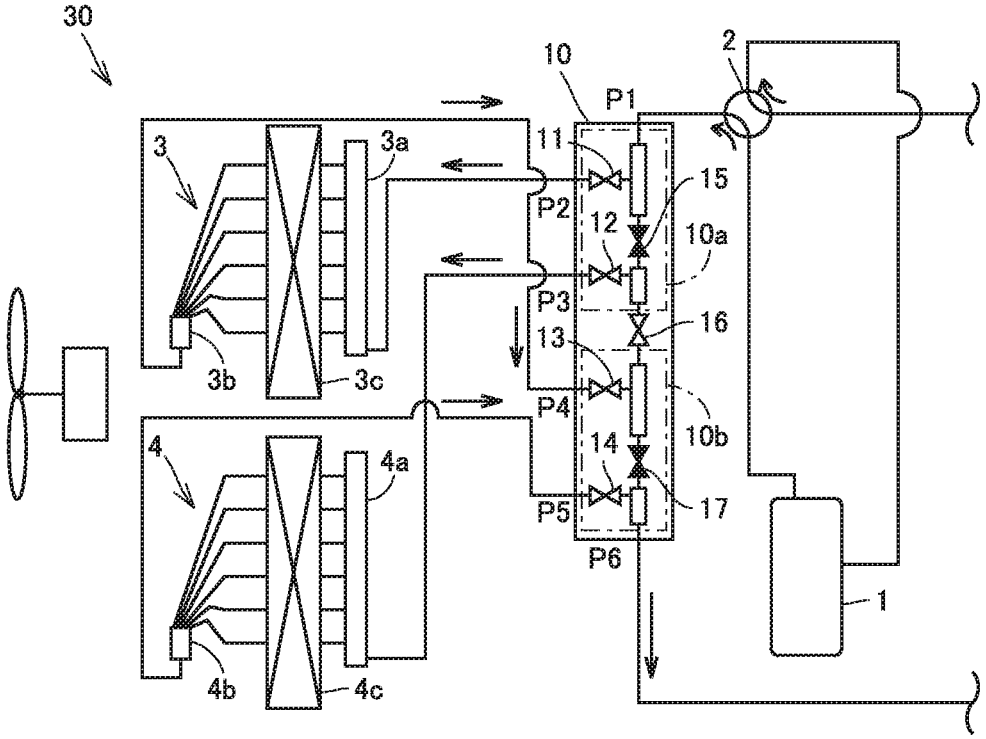
FIG. 3 illustrates a refrigerant flow path in an outdoor unit when the second flow path switching unit shown in FIG. 1 is in the third state.

As shown in FIG. 3, in the third state, first on-off valve 11, second on-off valve 12, third on-off valve 13, fourth on-off valve 14 and sixth on-off valve 16 are opened, while fifth on-off valve 15 and seventh on-off valve 17 are closed.

Figure 4:
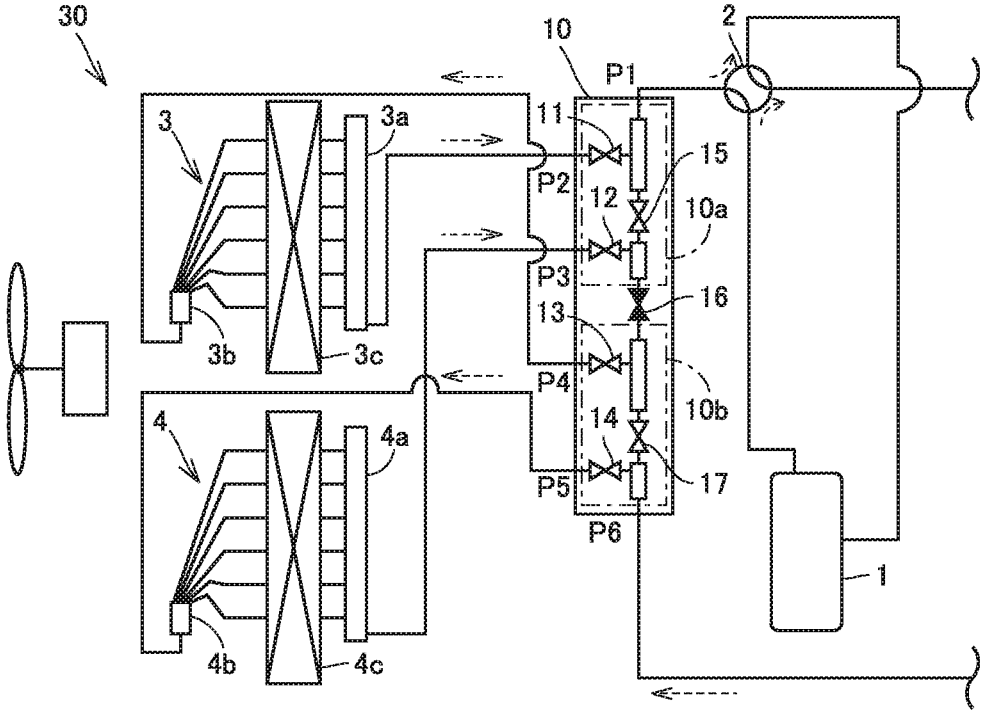
FIG. 4 illustrates a refrigerant flow path in the outdoor unit when the second flow path switching unit shown in FIG. 1 is in the fourth state.

As shown in FIG. 4, in the fourth state, first on-off valve 11, second on-off valve 12, third on-off valve 13, fourth on-off valve 14, fifth on-off valve 15 and seventh on-off valve 17 are opened, while sixth on-off valve 16 is closed.

Figure 5:
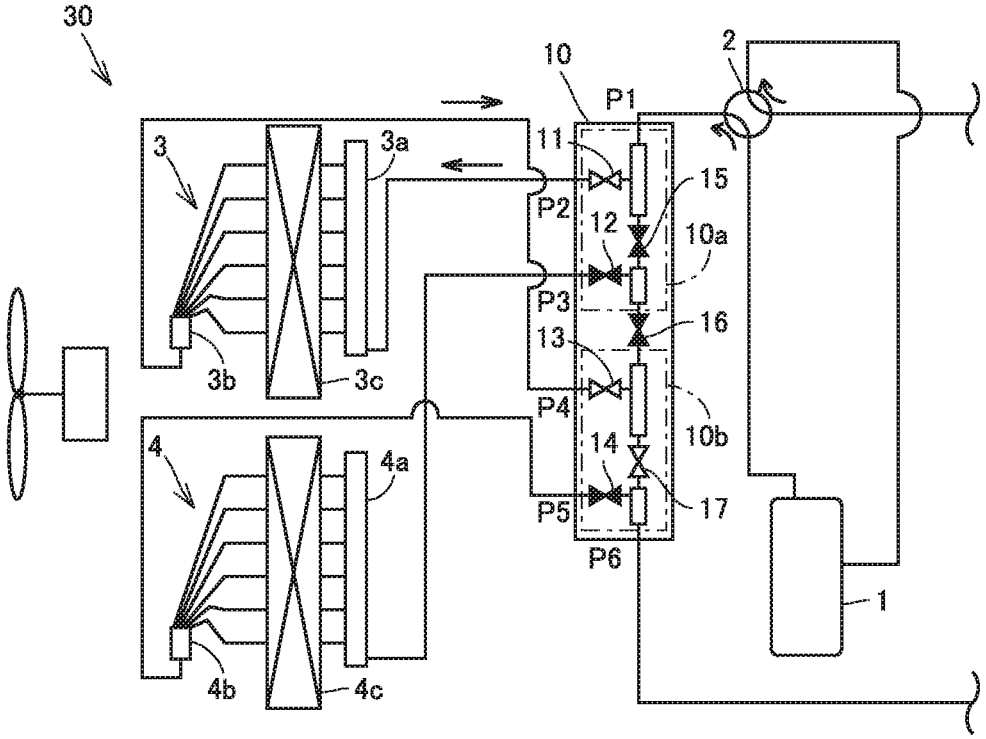
FIG. 5 illustrates a refrigerant flow path in the outdoor unit when the second flow path switching unit shown in FIG. 1 is in the fifth state.

As shown in FIG. 5, in the fifth state, first on-off valve 11, third on-off valve 13 and seventh on-off valve 17 are opened, while second on-off valve 12, fourth on-off valve 14, fifth on-off valve 15 and sixth on-off valve 16 are closed.

Figure 6:
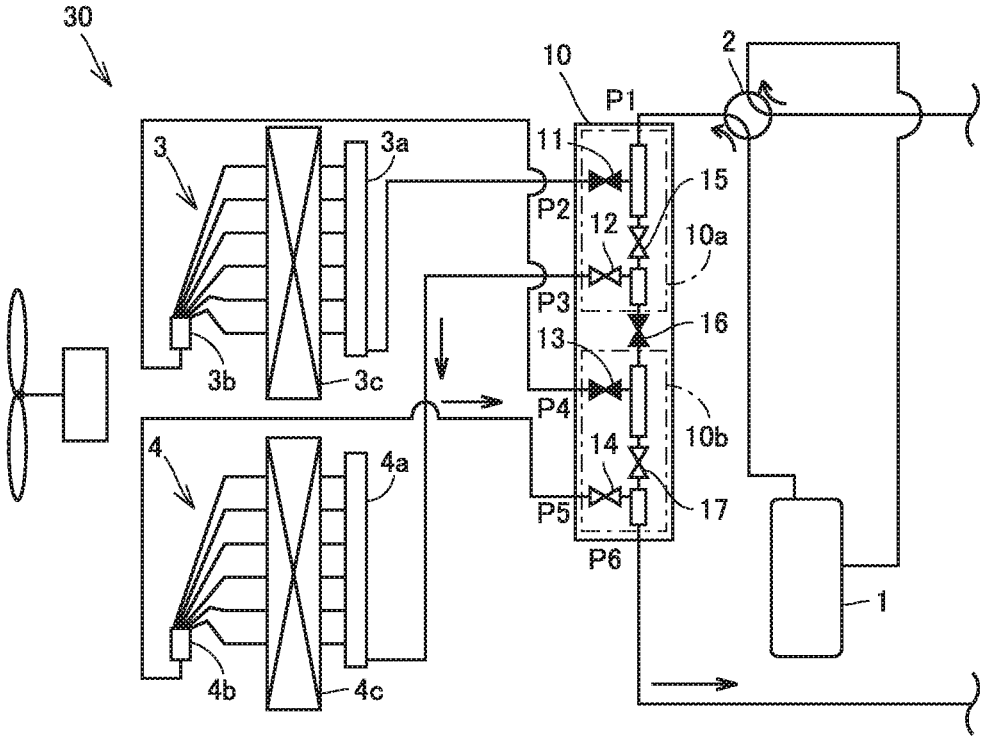
FIG. 6 illustrates a refrigerant flow path in the outdoor unit when the second flow path switching unit shown in FIG. 1 is in the sixth state.
Figure 7:
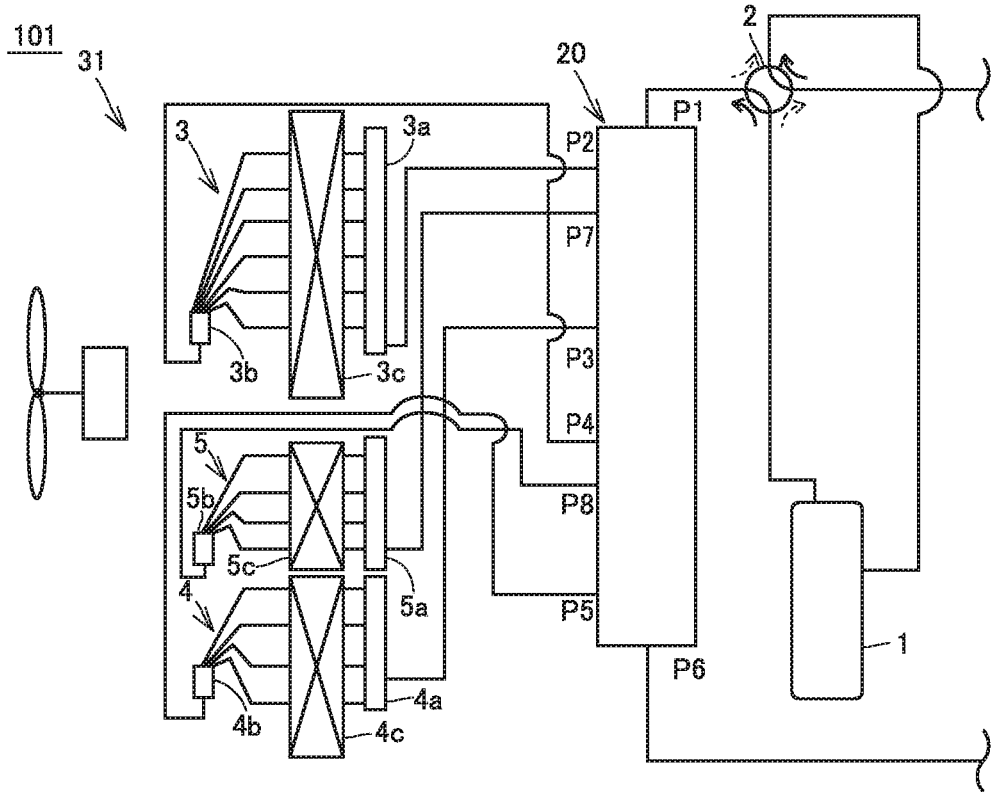
FIG. 7 illustrates a refrigeration cycle apparatus according to a second embodiment.

As shown in FIG. 6, in the sixth state, second on-off valve 12, fourth on-off valve 14, fifth on-off valve 15 and seventh on-off valve 17 are opened, while first on-off valve 11, third on-off valve 13 and sixth on-off valve 16 are closed.

Second flow path switching unit 10 may be divided, for example, into a first block and a second block, and sixth on-off valve 16 disposed between the first block and the second block. The first block has a portion of the first pipe path, the second pipe path, the third pipe path, first on-off valve 11, second on-off valve 12 and fifth on-off valve 15. The second block has another portion of the first pipe path, the fourth pipe path, the fifth pipe path, fourth on-off valve 14, fifth on-off valve 15 and seventh on-off valve 17. The first block is disposed, in the first state and the second state, on the gas refrigerant side with respect to first outdoor heat exchanger 3 and second outdoor heat exchanger 4. The second block is disposed, in the first state and the second state, on the liquid refrigerant side with respect to first outdoor heat exchanger 3 and second outdoor heat exchanger 4.

Each of first on-off valve 11, second on-off valve 12 and fifth on-off valve 15 included in the first block has a Cv value higher than that of each of third on-off valve 13, fourth on-off valve 14 and seventh on-off valve 17 included in the second block, for example.

Each of the portion of the first pipe path, the second pipe path and the third pipe path included in the first block has an inner diameter greater than that of each of the another portion of the first pipe path, the fourth pipe path and the fifth pipe path included in the second block, for example.

Second port P2, third port P3, fourth port P4 and fifth port P5 are disposed on the same plane, for example. A plane on which first port P1 is disposed is arranged, for example, opposite to a plane on which sixth port P6 is disposed. First port P1, second port P2, third port P3, fourth port P4, fifth port P5 and sixth port P6 may be disposed on the same plane.

As shown in FIGS. 1, and 3 to 4, in addition to compressor 1, four-way valve 2, first outdoor heat exchanger 3, second outdoor heat exchanger 4 and second flow path switching unit 10, for example, the first circuitry of the refrigerant circuit only has the discharge pipe, the suction pipe, a connection pipe connecting the third opening in four-way valve 2 to first pipe C1, a connection pipe connecting the fourth opening in four-way valve 2 to first port P1, a connection pipe connecting second port P2 to first distribution unit 3*a*, a connection pipe connecting third port P3 to third distribution unit 4*a*, a connection pipe connecting fourth port P4 to second distribution unit 3*b*, a connection pipe connecting fifth port P5 to fourth distribution unit 4*b*, and a connection pipe connecting sixth port P6 to the second pipe.

First indoor unit 40*a*, second indoor unit 40*b* and relay unit 50 may have any configuration, but are provided to be able to perform, for example, cooling-only operation, cooling-dominated operation, heating-only operation, and heating-dominated operation. First indoor unit 40*a*, second indoor unit 40*b* and relay unit 50 have configurations shown in FIG. 1, for example.

Operation of refrigeration cycle apparatus 100 is now described.

<Cooling Operation>

When refrigeration cycle apparatus 100 is in cooling operation, the third state, the fifth state or the sixth state is implemented depending on the cooling load. The third state is selected when the cooling load is relatively high. The third state is implemented during cooling-only operation, for example. The fifth state and the sixth state are implemented during cooling-dominated operation, for example.

As shown in FIG. 3, in the third state, first outdoor heat exchanger 3 and second outdoor heat exchanger 4 are connected in series in the first circuitry. Specifically, gas single-phase refrigerant discharged from compressor 1 flows through first port P1 into the first pipe path of second flow path switching unit 10.

In the third state, with first on-off valve 11 opened and fifth on-off valve 15 closed, the entire gas single-phase refrigerant that has flowed into the first pipe path passes through the second pipe path and flows into first distribution unit 3*a*, and exchanges heat with outdoor air and condenses in first outdoor heat exchanger 3. The liquid single-phase refrigerant or gas-liquid two-phase refrigerant condensed in first outdoor heat exchanger 3 passes through second distribution unit 3*b*, and flows through fourth port P4 into the fourth pipe path. With third on-off valve 13, sixth on-off valve 16 and second on-off valve 12 opened and fifth on-off valve 15 and seventh on-off valve 17 closed, the entire liquid single-phase refrigerant or gas-liquid two-phase refrigerant passes through the fourth pipe path, the first pipe path and the third pipe path and flows into third distribution unit 4*a*, and exchanges heat with outdoor air and condenses in second outdoor heat exchanger 4. The liquid single-phase refrigerant condensed in second outdoor heat exchanger 4 passes through fourth distribution unit 4*b*, and flows through sixth port P6 into the fifth pipe path. With fourth on-off valve 14 opened and seventh on-off valve 17 closed, the entire liquid single-phase refrigerant that has flowed into the fifth pipe path passes through the fifth pipe path and the first pipe path and flows out through second port P2. The liquid single-phase refrigerant that has flowed out through second port P2 flows into relay unit 50 via the second pipe.

In the second circuitry, the third circuitry and the fourth circuitry of the refrigerant circuit, the refrigerant is appropriately distributed by relay unit 50 depending on whether the operational status of refrigeration cycle apparatus 100 is cooling-only operation or cooling-dominated operation. During the cooling-only operation, for example, a part of the liquid single-phase refrigerant that has flowed into relay unit 50 is supplied to first indoor unit 40*a*, decompressed in first decompression unit 7*a*, then exchanges heat with indoor air and evaporates in first indoor heat exchanger 6*a*, and turns into gas single-phase refrigerant. Further, the remaining liquid single-phase refrigerant that has flowed into relay unit 50 is supplied to second indoor unit 40*b*, decompressed in second decompression unit 7*b*, then exchanges heat with indoor air and evaporates in second indoor heat exchanger 6*b*, and turns into gas single-phase refrigerant. The gas single-phase refrigerants that have flowed out of the indoor units join together in relay unit 50, and the joined refrigerant passes through the first pipe and is sucked through the suction port of compressor 1. The gas single-phase refrigerant is compressed by compressor 1, and then discharged through the discharge port again.

As shown in FIG. 5, in the fifth state, the refrigerant is not supplied to second outdoor heat exchanger 4, and second outdoor heat exchanger 4 does not serve as a condenser. In the fifth state, only first outdoor heat exchanger 3 serves as a condenser. Specifically, the gas single-phase refrigerant discharged from compressor 1 flows through first port P1 into the first pipe path of second flow path switching unit 10. With first on-off valve 11 opened and fifth on-off valve 15 closed, the entire gas single-phase refrigerant that has flowed into the first pipe path passes through the second pipe path and flows into first distribution unit 3*a*, and exchanges heat with outdoor air and condenses in first outdoor heat exchanger 3. The liquid single-phase refrigerant or gas-liquid two-phase refrigerant condensed in first outdoor heat exchanger 3 passes through second distribution unit 3*b*, and flows through fourth port P4 into the fourth pipe path. With third on-off valve 13 and seventh on-off valve 17 opened and fourth on-off valve 14 and sixth on-off valve 16 closed, the entire liquid single-phase refrigerant or gas-liquid two-phase refrigerant passes through the fourth pipe path and the first pipe path and flows out through second port P2.

As shown in FIG. 6, in the sixth state, the refrigerant is not supplied to first outdoor heat exchanger 3, and first outdoor heat exchanger 3 does not serve as a condenser. In the fifth state, only second outdoor heat exchanger 4 serves as a condenser. Specifically, the gas single-phase refrigerant discharged from compressor 1 flows through first port P1 into the first pipe path of second flow path switching unit 10. With second on-off valve 12 and fifth on-off valve 15 opened and first on-off valve 11 and sixth on-off valve 16 closed, the entire gas single-phase refrigerant that has flowed into the first pipe path passes through the third pipe path and flows into third distribution unit 4*a*, and exchanges heat with outdoor air and condenses in second outdoor heat exchanger 4. The liquid single-phase refrigerant or gas-liquid two-phase refrigerant condensed in second outdoor heat exchanger 4 passes through fourth distribution unit 4*b*, and flows through sixth port P6 into the fifth pipe path. With fourth on-off valve 14 opened and seventh on-off valve 17 closed, the entire liquid single-phase refrigerant or gas-liquid two-phase refrigerant passes through the fifth pipe path and the first pipe path and flows out through second port P2.

<Heating Operation>

When refrigeration cycle apparatus 100 is in heating operation, the fourth state is implemented. As shown in FIG. 4, in the fourth state, first outdoor heat exchanger 3 and second outdoor heat exchanger 4 are connected in parallel in the first circuitry. Specifically, the gas single-phase refrigerant discharged from compressor 1 condenses in at least one of first indoor heat exchanger 6*a* and second indoor heat exchanger 6*b* shown in FIG. 1, and turns into liquid single-phase refrigerant. The liquid single-phase refrigerant is decompressed in first decompression unit 7*a* or second decompression unit 7*b*, and turns into gas-liquid two-phase refrigerant. The gas-liquid two-phase refrigerant passes through second pipe C2 and flows through sixth port P6 into the first pipe path of second flow path switching unit 10.

In the fourth state, third on-off valve 13, fourth on-off valve 14 and seventh on-off valve 17 are opened, while sixth on-off valve 16 is closed. Thus, a part of the gas-liquid two-phase refrigerant that has flowed into the first pipe path passes through the third pipe path and flows into second distribution unit 3*b*, exchanges heat with outdoor air and evaporates in first outdoor heat exchanger 3, and turns into gas single-phase refrigerant. The remaining gas-liquid two-phase refrigerant that has flowed into the first pipe path passes through the fourth pipe path and flows into fourth distribution unit 4*b*, exchanges heat with outdoor air and evaporates in second outdoor heat exchanger 4, and turns into gas single-phase refrigerant.

The gas single-phase refrigerant evaporated in first outdoor heat exchanger 3 passes through first distribution unit 3*a*, and flows through second port P2 into the second pipe path. The gas single-phase refrigerant evaporated in second outdoor heat exchanger 4 passes through third distribution unit 4*a*, and flows through third port P3 into the third pipe path. With first on-off valve 11, second on-off valve 12 and fifth on-off valve 15 opened and sixth on-off valve 16 closed, the entire gas single-phase refrigerant passes through the first pipe path and flows out through first port P1. The gas single-phase refrigerant that has flowed out through first port P1 is sucked through the suction port of compressor 1.

<Functions and Effects>

Refrigeration cycle apparatus 100 includes compressor 1, four-way valve 2, second flow path switching unit 10, first outdoor heat exchanger 3, second outdoor heat exchanger 4, first indoor heat exchanger 6*a*, second indoor heat exchanger 6*b*, and second flow path switching unit 10, to form a refrigerant circuit through which refrigerant circulates. First outdoor heat exchanger 3 has first distribution unit 3*a* and second distribution unit 3*b* to/from which the refrigerant flows in/out. Second outdoor heat exchanger 4 has third distribution unit 4*a* and fourth distribution unit 4*b* to/from which the refrigerant flows in/out. Four-way valve 2 switches between the first state in which at least one of first outdoor heat exchanger 3 and second outdoor heat exchanger 4 serves as a condenser, and the second state in which at least one of first outdoor heat exchanger 3 and second outdoor heat exchanger 4 serves as an evaporator. Second flow path switching unit 10 has first port P1, second port P2, third port P3, fourth port P4, fifth port P5, and sixth port P6 through which the refrigerant flows in/out. First port P1 is connected to the discharge port of compressor 1 via four-way valve 2 in the first state, and is connected to the suction port of compressor 1 via four-way valve 2 in the second state. Second port P2 is connected to first distribution unit 3*a*. Third port P3 is connected to third distribution unit 4*a*. Fourth port P4 is connected to second distribution unit 3*b*. Fifth port P5 is connected to fourth distribution unit 4*b*. Sixth port P6 is connected to the third heat exchanger. Second flow path switching unit 10 switches between the third state in which first port P1, second port P2, the first heat exchanger, fourth port P4, third port P3, the second heat exchanger, fifth port P5 and sixth port P6 are successively connected in series, and the fourth state in which sixth port P6, fourth port P4, first outdoor heat exchanger 3, second port P2 and first port P1 are successively connected in series, and sixth port P6, fifth port P5, second outdoor heat exchanger 4, third port P3 and first port P1 are successively connected in series.

According to refrigeration cycle apparatus 100, second flow path switching unit 10 switches between the third state in which first outdoor heat exchanger 3 and second outdoor heat exchanger 4 are connected in series, and the fourth state in which first outdoor heat exchanger 3 and second outdoor heat exchanger 4 are connected in parallel. Thus, the third state is implemented during cooling operation and the fourth state is implemented during heating operation by second flow path switching unit 10, allowing refrigeration cycle apparatus 100 to have a coefficient of performance COP higher than that of a conventional refrigeration cycle apparatus which does not include second flow path switching unit 10 and in which the switching does not takes place.

For example, in refrigeration cycle apparatus 100 in which the third state is implemented during the cooling operation, the refrigerant flowing through one heat transfer tube of first outdoor heat exchanger 3 and second outdoor heat exchanger 4 during the cooling operation has an increased flow rate, and has an increased flow velocity, leading to an increased heat transfer rate in the pipe, compared to a refrigeration cycle apparatus in which the fourth state is maintained during the cooling and heating operations. As a result, refrigeration cycle apparatus 100 has condensation heat transfer performance higher than that of the above-mentioned refrigeration cycle apparatus, and refrigeration cycle apparatus 100 has a coefficient of performance COP higher than that of the above-mentioned refrigeration cycle apparatus.

In addition, for example, in refrigeration cycle apparatus 100 in which the fourth state is implemented during the heating operation, a pressure loss of the refrigerant flowing through the heat transfer tubes of first outdoor heat exchanger 3 and second outdoor heat exchanger 4 during the heating operation can be reduced, compared to a refrigeration cycle apparatus in which the third state is maintained during the cooling and heating operations. As a result, refrigeration cycle apparatus 100 has a coefficient of performance COP higher than that of the above-mentioned refrigeration cycle apparatus.

Further, in refrigeration cycle apparatus 100, second flow path switching unit 10 is configured as a single unit having first port P1, second port P2, third port P3, fourth port P4, fifth port P5 and sixth port P6. Thus, switching among the third state, the fifth state, the sixth state and the fourth state is implemented by switching of the flow paths in second flow path switching unit 10. As a result, pipes connecting the ports of second flow path switching unit 10 to the components other than second flow path switching unit 10 disposed in outdoor unit 30 in a one-to-one relationship are the only pipes forming the first circuitry in outdoor unit 30 outside second flow path switching unit 10. Accordingly, routing of the pipes forming the first circuitry in outdoor unit 30 outside second flow path switching unit 10 is simplified compared to routing of pipes connecting a check valve and an on-off valve to a plurality of unit flow paths in the above-mentioned conventional air conditioner.

Further, the relative positions of first port P1, second port P2, third port P3, fourth port P4, fifth port P5 and sixth port P6 of second flow path switching unit 10 do not need to be changed upon connection to first outdoor heat exchanger 3 and second outdoor heat exchanger 4 having different specifications. Thus, second flow path switching unit 10 can remain unchanged among a plurality of refrigeration cycle apparatuses 100 having different horsepowers and the like. That is, in refrigeration cycle apparatus 100, it is unnecessary to change the design of the routing of the refrigerant pipes depending on the horsepower, the time when the apparatus is put into use, whether or not the apparatus is a so-called high-performance apparatus, and the like. That is, in refrigeration cycle apparatus 100, a standardized design of the first circuitry of the refrigerant circuit in outdoor unit 30 is possible.

In this manner, in refrigeration cycle apparatus 100, the routing of the refrigerant pipes disposed in outdoor unit 30 can be simplified to reduce the length of the refrigerant pipes, compared to a refrigeration cycle apparatus in which the routing of refrigerant pipes including a check valve and a solenoid valve needs to be designed depending on the horsepower and the like of the refrigeration cycle apparatus. As a result, the space to install the refrigerant pipes in outdoor unit 30 is reduced compared to the above-mentioned refrigeration cycle apparatus, and the manufacturing cost of refrigeration cycle apparatus 100 is reduced compared to the above-mentioned refrigeration cycle apparatus.

In refrigeration cycle apparatus 100, second flow path switching unit 10 switches among the third state, the fourth state, the fifth state in which first port P1, second port P2, the first heat exchanger, fourth port P4 and sixth port P6 are successively connected in series, and the sixth state in which first port P1, third port P3, the second heat exchanger, fifth port P5 and sixth port P6 are successively connected in series. One of the third state, the fifth state and the sixth state is selected when the refrigeration cycle apparatus is in the first state. The fourth state is selected when the refrigeration cycle apparatus is in the second state.

According to refrigeration cycle apparatus 100, second flow path switching unit 10 switches among, in addition to the third state and the fourth state, the fifth state in which the refrigerant is not supplied to second outdoor heat exchanger 4, and the sixth state in which the refrigerant is not supplied to first outdoor heat exchanger 3. The fifth state and the sixth state are implemented during cooling operation with a relatively low air-conditioning load (during cooling low-load operation).

When outdoor air temperature is low during cooling-dominated operation, for example, heat dissipation performance of each of first outdoor heat exchanger 3 and second outdoor heat exchanger 4 becomes excessive if each of them is operated as a condenser, resulting in a reduction in condensing pressure compared to that during normal cooling operation. As a result, gas-phase refrigerant to be supplied to the indoor heat exchanger in heating operation decreases in saturation temperature, resulting in inability to obtain required heating performance. In addition, if a compression ratio (condensing pressure/evaporating pressure) is maintained at low level due to the reduction in condensing pressure, the reliability of the compressor decreases.

In such a case, in refrigeration cycle apparatus 100, the fifth state or the sixth state is implemented by second flow path switching unit 10, allowing a reduction in heat dissipation performance of the condenser, to suppress the reduction in condensing pressure. As a result, in refrigeration cycle apparatus 100, required heating performance can be obtained even in the case such as described above. Further, in this case, the reliability of compressor 1 is ensured because the reduction in condensing pressure is suppressed in refrigeration cycle apparatus 100.

In addition, when first outdoor heat exchanger 3 and second outdoor heat exchanger 4 have different capacities, second flow path switching unit 10 can switch between the fifth state and the sixth state depending on the air-conditioning load. Variation in condensing pressure is thereby suppressed.

Second Embodiment

A refrigeration cycle apparatus 101 according to a second embodiment has a configuration basically similar to that of refrigeration cycle apparatus 100 according to the first embodiment, but differs in that the refrigerant circuit includes a second flow path switching unit 20 instead of second flow path switching unit 10, and further includes a third outdoor heat exchanger 5 as a fourth heat exchange unit.

Third outdoor heat exchanger 5 has a fifth distribution unit 5*a* as a fifth flow-in/out portion and a sixth distribution unit 5*b* as a sixth flow-in/out portion to/from which the refrigerant flows in/out.

Second flow path switching unit 20 has a configuration basically similar to that of second flow path switching unit 10, but differs in that it further has a seventh port P7 and an eighth port P8 through which the refrigerant flows in/out. Seventh port P7 is connected to fifth distribution unit 5*a*. Eighth port P8 is connected to sixth distribution unit 5*b*.

Second flow path switching unit 10 switches among the third state, the fifth state, the sixth state, the fourth state, and a seventh state.

Figure 8:
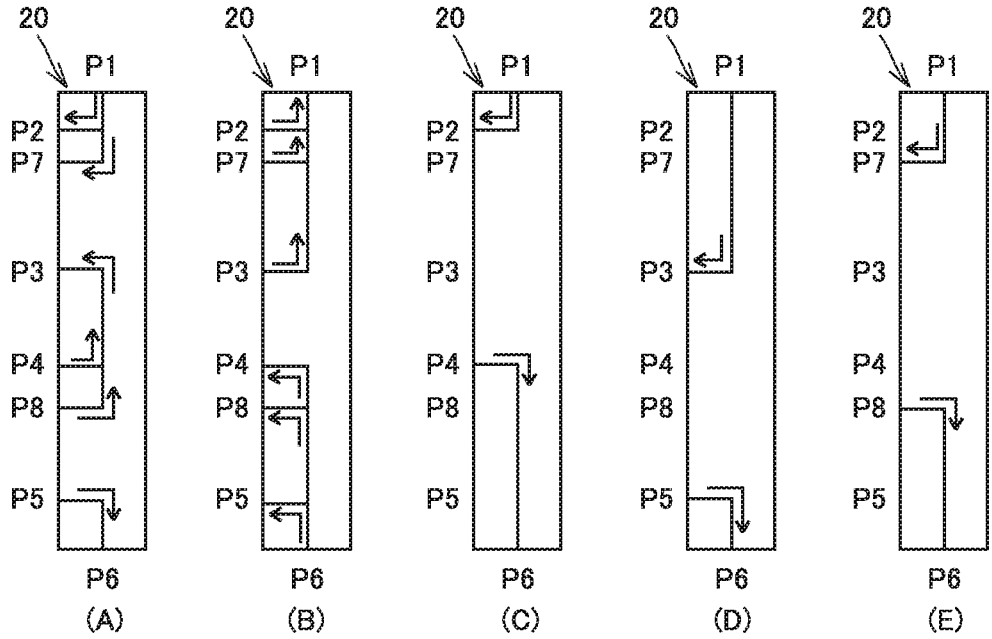
FIG. 8 shows a diagram (A) illustrating a refrigerant flow path in a second flow path switching unit shown in FIG. 7 when the second flow path switching unit is in a third state, a diagram (B) illustrating a refrigerant flow path in the second flow path switching unit shown in FIG. 7 when the second flow path switching unit is in a fourth state, a diagram (C) illustrating a refrigerant flow path in the second flow path switching unit shown in FIG. 7 when the second flow path switching unit is in a fifth state, a diagram (D) illustrating a refrigerant flow path in the second flow path switching unit shown in FIG. 7 when the second flow path switching unit is in a sixth state, and a diagram (E) illustrating a refrigerant flow path in the second flow path switching unit shown in FIG. 7 when the second flow path switching unit is in a seventh state.

In the third state shown in FIGS. 8 (A) and 9, first port P1, second port P2, fourth port P4, third port P3, fifth port P5 and sixth port P6 are successively connected in series, and first port P1, seventh port P7, eighth port P8, third port P3, fifth port P5 and sixth port P6 are successively connected in series. That is, in the third state, first outdoor heat exchanger 3 and second outdoor heat exchanger 4 are connected in series, and third outdoor heat exchanger 5 and second outdoor heat exchanger 4 are connected in series. From a different viewpoint, in the third state, first outdoor heat exchanger 3 and third outdoor heat exchanger 5 are connected in parallel with second outdoor heat exchanger 4.

As shown in FIG. 8 (A), in the third state, in addition to the first flow path, the second flow path and the third flow path, second flow path switching unit 20 further has a sixth flow path connecting first port P1 to seventh port P7, and a seventh flow path connecting eighth port P8 to third port P3. In the third state, the first flow path and the sixth flow path are connected in parallel, and the second flow path and the seventh flow path are connected in parallel.

In the fourth state shown in FIGS. 8 (B) and 10, fourth port P4, fifth port P5 and eighth port P8 are connected in parallel with sixth port P6, and second port P2, third port P3 and seventh port P7 are connected in parallel with first port P1. Second flow path switching unit 20 has, in the fourth state, the first flow path, the fifth flow path, the sixth flow path, the third flow path, the fourth flow path and the seventh flow path. The first flow path, the fifth flow path and the sixth flow path are connected to one another in parallel. The third flow path, the fourth flow path and the seventh flow path are connected to one another in parallel. That is, in the fourth state, first outdoor heat exchanger 3, second outdoor heat exchanger 4 and third outdoor heat exchanger 5 are connected in parallel.

In the fifth state shown in FIGS. 8 (C) and 11, a state similar to the fifth state shown in FIGS. 2 (C) and 5 is implemented. Second flow path switching unit 20 has, in the fifth state, only the first flow path and the fourth flow path. In the sixth state shown in FIGS. 8 (D) and 12, a state similar to the sixth state shown in FIGS. 2 (D) and 6 is implemented. Second flow path switching unit 20 has, in the sixth state, only the fifth flow path and the third flow path. That is, in the fifth state, the refrigerant flowing through the first circuitry is not supplied to second outdoor heat exchanger 4 and third outdoor heat exchanger 5, and the refrigerant is supplied only to first outdoor heat exchanger 3. In the sixth state, the refrigerant flowing through the first circuitry is not supplied to first outdoor heat exchanger 3 and third outdoor heat exchanger 5, and the refrigerant is supplied only to second outdoor heat exchanger 4.

In the seventh state shown in FIGS. 8 (E) and 13, first port P1, seventh port P7, eighth port P8 and sixth port P6 are successively connected in series. Second flow path switching unit 20 has, in the seventh state, only the sixth flow path and an eighth flow path. That is, in the seventh state, the refrigerant flowing through the first circuitry is not supplied to first outdoor heat exchanger 3 and second outdoor heat exchanger 4, and the refrigerant is supplied only to third outdoor heat exchanger 5. Arrows shown in FIGS. 8 (A) to (E) indicate flow directions of the refrigerant in the respective states.

The seventh state is selected when refrigeration cycle apparatus 100 is in the first state.

In addition to the first pipe path, the second pipe path, the third pipe path, the fourth pipe path, the fifth pipe path, first on-off valve 11, second on-off valve 12, third on-off valve 13, fourth on-off valve 14, fifth on-off valve 15, sixth on-off valve 16 and seventh on-off valve 17, second flow path switching unit 20 further includes a sixth pipe path, a seventh pipe path, an eighth on-off valve 18 and a ninth on-off valve 19.

The sixth pipe path connects seventh port P7 to the first pipe path. The seventh pipe path connects eighth port P8 to the first pipe path. The second pipe path, the third pipe path, the fourth pipe path, the fifth pipe path, the sixth pipe path and the seventh pipe path are connected to one another in parallel with respect to the first pipe path. A connection portion between the first pipe path and the seventh pipe path is defined as a fifth connection portion, and a connection portion between the first pipe path and an eighth pipe path is defined as a sixth connection portion.

The seventh pipe path is connected to a portion located between the first connection portion and the second connection portion in the first pipe path. The eighth pipe path is connected to a portion located between the third connection portion and the fourth connection portion in the first pipe path.

Eighth on-off valve 18 opens and closes the sixth pipe path. Ninth on-off valve 19 opens and closes the seventh pipe path. Fifth on-off valve 15 opens and closes a portion located between the fifth connection portion and the second connection portion in the first pipe path. Seventh on-off valve 17 opens and closes a portion located between the sixth connection portion and the fourth connection portion in the first pipe path.

Figure 9:
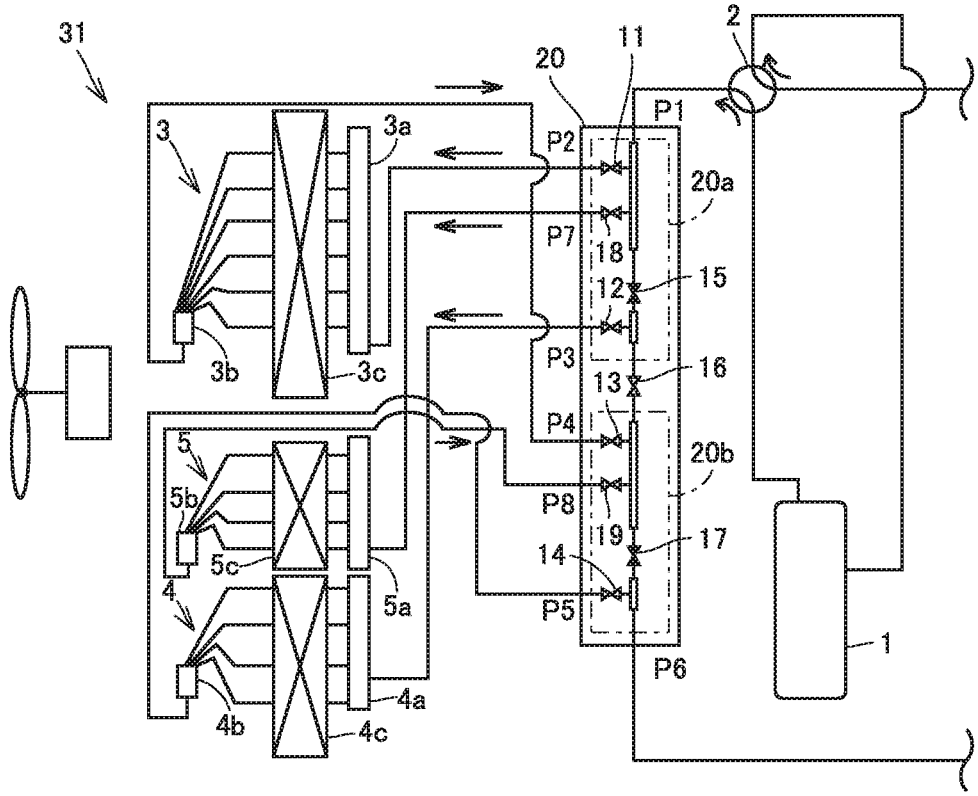
FIG. 9 illustrates a refrigerant flow path in an outdoor unit when the second flow path switching unit shown in FIG. 7 is in the third state.

As shown in FIG. 9, in the third state, first on-off valve 11, second on-off valve 12, third on-off valve 13, fourth on-off valve 14, sixth on-off valve 16, eighth on-off valve 18 and ninth on-off valve 19 are opened, while fifth on-off valve 15 and seventh on-off valve 17 are closed.

Figure 10:
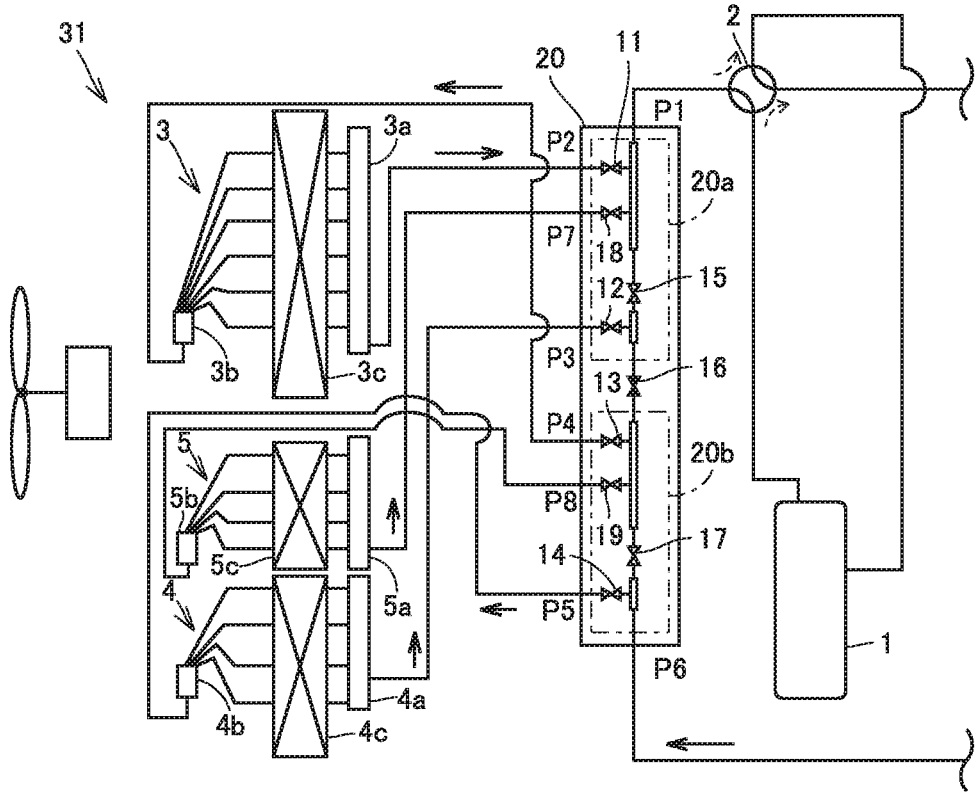
FIG. 10 illustrates a refrigerant flow path in the outdoor unit when the second flow path switching unit shown in FIG. 7 is in the fourth state.

As shown in FIG. 10, in the fourth state, first on-off valve 11, second on-off valve 12, third on-off valve 13, fourth on-off valve 14, fifth on-off valve 15, seventh on-off valve 17, eighth on-off valve 18 and ninth on-off valve 19 are opened, while sixth on-off valve 16 is closed.

Figure 11:
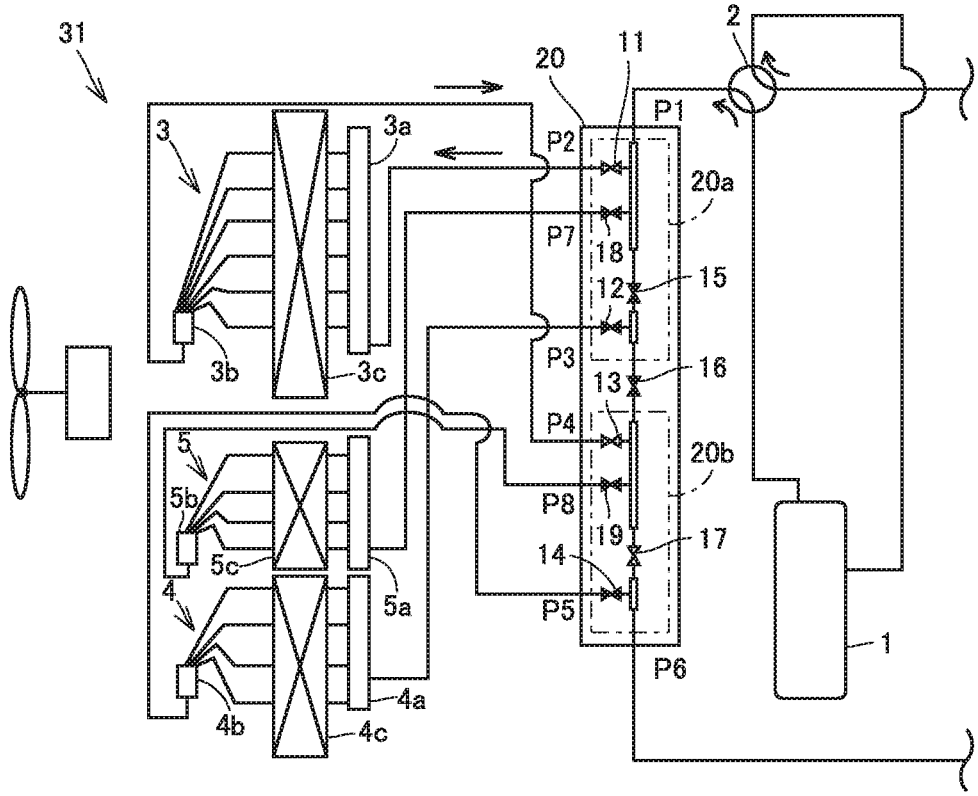
FIG. 11 illustrates a refrigerant flow path in the outdoor unit when the second flow path switching unit shown in FIG. 7 is in the fifth state.

As shown in FIG. 11, in the fifth state, first on-off valve 11, third on-off valve 13 and seventh on-off valve 17 are opened, while second on-off valve 12, fourth on-off valve 14, fifth on-off valve 15, sixth on-off valve 16, eighth on-off valve 18 and ninth on-off valve 19 are closed.

Figure 12:
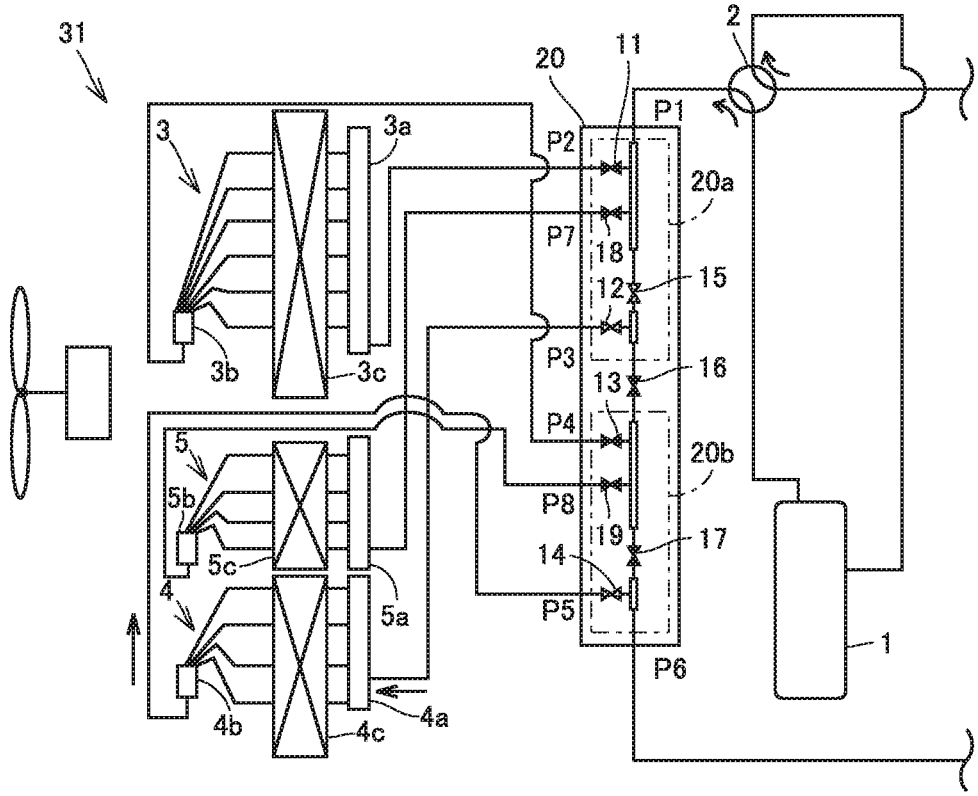
FIG. 12 illustrates a refrigerant flow path in the outdoor unit when the second flow path switching unit shown in FIG. 7 is in the sixth state.

As shown in FIG. 12, in the sixth state, second on-off valve 12, fourth on-off valve 14, fifth on-off valve 15 and seventh on-off valve 17 are opened, while first on-off valve 11, third on-off valve 13 and sixth on-off valve 16 are closed.

Figure 13:
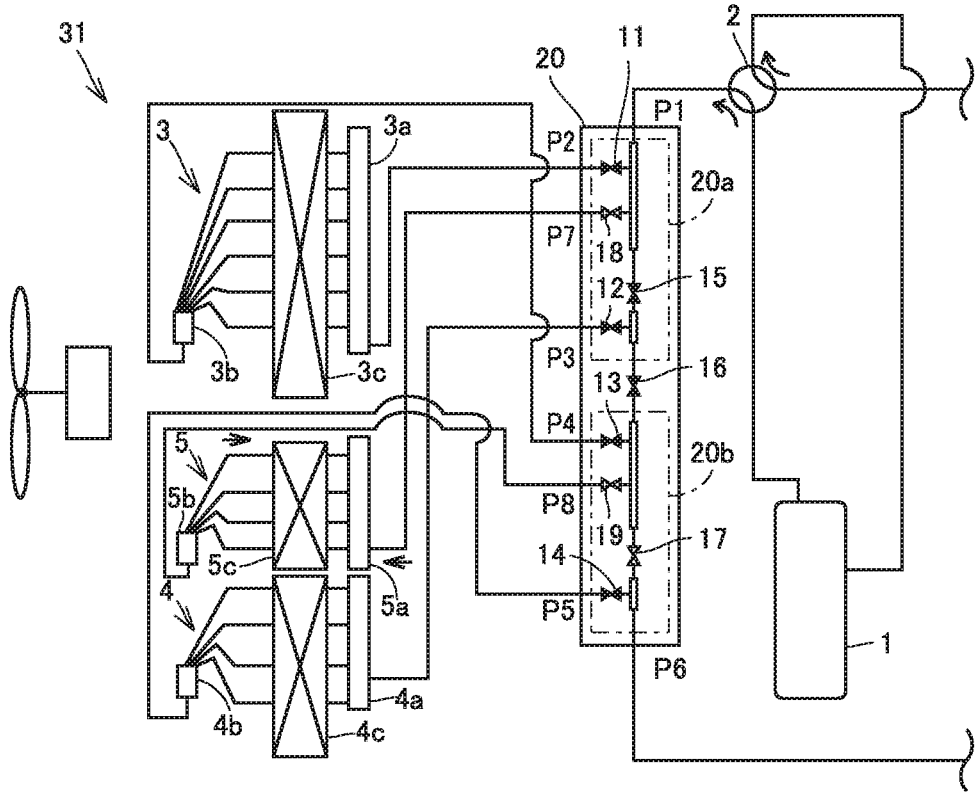
FIG. 13 illustrates a refrigerant flow path in the outdoor unit when the second flow path switching unit shown in FIG. 7 is in the seventh state.

As shown in FIG. 13, in the seventh state, seventh on-off valve 17, eighth on-off valve 18 and ninth on-off valve 19 are opened, while first on-off valve 11, second on-off valve 12, third on-off valve 13, fourth on-off valve 14, fifth on-off valve 15 and sixth on-off valve 16 are closed.

Second flow path switching unit 10 is configured as a single unit. Second flow path switching unit 20 may be divided, for example, into a first block and a second block, and sixth on-off valve 16 disposed between the first block and the second block. The first block has a portion of the first pipe path, the second pipe path, the third pipe path, the sixth pipe path, first on-off valve 11, second on-off valve 12, fifth on-off valve 15 and eighth on-off valve 18. The second block has another portion of the first pipe path, the fourth pipe path, the fifth pipe path, the seventh pipe path, fourth on-off valve 14, fifth on-off valve 15, seventh on-off valve 17 and ninth on-off valve 19. The first block is disposed, in the first state and the second state, on the gas refrigerant side with respect to first outdoor heat exchanger 3, second outdoor heat exchanger 4 and third outdoor heat exchanger 5. The second block is disposed, in the first state and the second state, on the liquid refrigerant side with respect to first outdoor heat exchanger 3, second outdoor heat exchanger 4 and third outdoor heat exchanger 5.

Each of first on-off valve 11, second on-off valve 12, fifth on-off valve 15 and eighth on-off valve 18 included in the first block has a Cv value higher than that of each of third on-off valve 13, fourth on-off valve 14, seventh on-off valve 17 and ninth on-off valve 19 included in the second block, for example.

Each of the portion of the first pipe path, the second pipe path, the third pipe path and the sixth pipe path included in the first block has an inner diameter greater than that of each of the another portion of the first pipe path, the fourth pipe path, the fifth pipe path and the seventh pipe path included in the second block, for example.

Second port P2, third port P3, fourth port P4, fifth port P5, seventh port P7 and eighth port P8 are disposed on the same plane, for example. First port P1, second port P2, third port P3, fourth port P4, fifth port P5, sixth port P6, seventh port P7 and eighth port P8 may be disposed on the same plane.

Operation of refrigeration cycle apparatus 101 is now described.

<Cooling Operation>

When refrigeration cycle apparatus 101 is in cooling operation, the third state, the fifth state, the sixth state or the seventh state is implemented depending on the cooling load. The third state is selected when the cooling load is relatively high. The third state is implemented during cooling-only operation, for example. The fifth state, the sixth state and the seventh state are implemented during cooling-dominated operation, for example.

As shown in FIG. 9, in the third state, first outdoor heat exchanger 3 and second outdoor heat exchanger 4 are connected in series in the first circuitry, and third outdoor heat exchanger 5 and second outdoor heat exchanger 4 are connected in series in the first circuitry.

The gas single-phase refrigerant discharged from compressor 1 flows through first port P1 into the first pipe path of second flow path switching unit 10.

In the third state, first on-off valve 11 and eighth on-off valve 18 are opened, while fifth on-off valve 15 is closed. Thus, a part of the gas single-phase refrigerant that has flowed into the first pipe path passes through the second pipe path and flows through second port P2 into first distribution unit 3*a*, and exchanges heat with outdoor air and condenses in first outdoor heat exchanger 3. The liquid single-phase refrigerant or gas-liquid two-phase refrigerant condensed in first outdoor heat exchanger 3 passes through second distribution unit 3*b*, and flows through fourth port P4 into the fourth pipe path. The remaining gas single-phase refrigerant that has flowed into the first pipe path passes through the sixth pipe path and flows through seventh port P7 into fifth distribution unit 5*a*, and exchanges heat with outdoor air and condenses in third outdoor heat exchanger 5. The liquid single-phase refrigerant or gas-liquid two-phase refrigerant condensed in third outdoor heat exchanger 5 passes through sixth distribution unit 5*b*, and flows through eighth port P8 into the seventh pipe path.

With third on-off valve 13, ninth on-off valve 19, sixth on-off valve 16 and second on-off valve 12 opened and fifth on-off valve 15 and seventh on-off valve 17 closed, the entire liquid single-phase refrigerant or gas-liquid two-phase refrigerant passes through the fourth pipe path, the first pipe path and the third pipe path and flows through third port P3 into third distribution unit 4*a*, and exchanges heat with outdoor air and condenses in second outdoor heat exchanger 4. The liquid single-phase refrigerant condensed in second outdoor heat exchanger 4 passes through fourth distribution unit 4*b*, and flows through sixth port P6 into the fifth pipe path. With fourth on-off valve 14 opened and seventh on-off valve 17 closed, the entire liquid single-phase refrigerant that has flowed into the fifth pipe path passes through the fifth pipe path and the first pipe path and flows out through second port P2. The liquid single-phase refrigerant that has flowed out through second port P2 flows into relay unit 50 via the second pipe.

As shown in FIG. 11, in the fifth state, the refrigerant is not supplied to second outdoor heat exchanger 4 and third outdoor heat exchanger 5, and each of second outdoor heat exchanger 4 and third outdoor heat exchanger 5 does not serve as a condenser. In the fifth state, only first outdoor heat exchanger 3 serves as a condenser. Specifically, the gas single-phase refrigerant discharged from compressor 1 flows through first port P1 into the first pipe path of second flow path switching unit 10. With first on-off valve 11 opened and fifth on-off valve 15 and eighth on-off valve 18 closed, the entire gas single-phase refrigerant that has flowed into the first pipe path passes through the second pipe path and flows into first distribution unit 3*a*, and exchanges heat with outdoor air and condenses in first outdoor heat exchanger 3. The liquid single-phase refrigerant or gas-liquid two-phase refrigerant condensed in first outdoor heat exchanger 3 passes through second distribution unit 3*b*, and flows through fourth port P4 into the fourth pipe path. With third on-off valve 13 and seventh on-off valve 17 opened and fourth on-off valve 14, sixth on-off valve 16 and ninth on-off valve 19 closed, the entire liquid single-phase refrigerant or gas-liquid two-phase refrigerant passes through the fourth pipe path and the first pipe path and flows out through second port P2.

As shown in FIG. 12, in the sixth state, the refrigerant is not supplied to first outdoor heat exchanger 3 and third outdoor heat exchanger 5, and each of first outdoor heat exchanger 3 and third outdoor heat exchanger 5 does not serve as a condenser. In the fifth state, only second outdoor heat exchanger 4 serves as a condenser. Specifically, the gas single-phase refrigerant discharged from compressor 1 flows through first port P1 into the first pipe path of second flow path switching unit 10. With second on-off valve 12 and fifth on-off valve 15 opened and first on-off valve 11, sixth on-off valve 16 and eighth on-off valve 18 closed, the entire gas single-phase refrigerant that has flowed into the first pipe path passes through the third pipe path and flows into third distribution unit 4*a*, and exchanges heat with outdoor air and condenses in second outdoor heat exchanger 4. The liquid single-phase refrigerant or gas-liquid two-phase refrigerant condensed in second outdoor heat exchanger 4 passes through fourth distribution unit 4*b*, and flows through sixth port P6 into the fifth pipe path. With fourth on-off valve 14 opened and sixth on-off valve 16, seventh on-off valve 17 and ninth on-off valve 19 closed, the entire liquid single-phase refrigerant or gas-liquid two-phase refrigerant passes through the fifth pipe path and the first pipe path and flows out through second port P2.

As shown in FIG. 13, in the seventh state, the refrigerant is not supplied to first outdoor heat exchanger 3 and second outdoor heat exchanger 4, and each of first outdoor heat exchanger 3 and second outdoor heat exchanger 4 does not serve as a condenser. In the seventh state, only third outdoor heat exchanger 5 serves as a condenser. Specifically, the gas single-phase refrigerant discharged from compressor 1 flows through first port P1 into the first pipe path of second flow path switching unit 10. With eighth on-off valve 18 opened and first on-off valve 11 and fifth on-off valve 15 closed, the entire gas single-phase refrigerant that has flowed into the first pipe path passes through the sixth pipe path and flows into fifth distribution unit 5*a*, and exchanges heat with outdoor air and condenses in third outdoor heat exchanger 5. The liquid single-phase refrigerant or gas-liquid two-phase refrigerant condensed in third outdoor heat exchanger 5 passes through sixth distribution unit 5*b*, and flows through eighth port P8 into the seventh pipe path. With seventh on-off valve 17 and ninth on-off valve 19 opened and third on-off valve 13, fourth on-off valve 14 and sixth on-off valve 16 closed, the entire liquid single-phase refrigerant or gas-liquid two-phase refrigerant passes through the fifth pipe path and the first pipe path and flows out through second port P2.

<Heating Operation>

When refrigeration cycle apparatus 101 is in heating operation, the fourth state is implemented. As shown in FIG. 10, in the fourth state, first outdoor heat exchanger 3, second outdoor heat exchanger 4 and third outdoor heat exchanger 5 are connected in parallel in the first circuitry. Specifically, the gas single-phase refrigerant discharged from compressor 1 condenses in at least one of first indoor heat exchanger 6*a* and second indoor heat exchanger 6*b* shown in FIG. 1, and turns into liquid single-phase refrigerant. The liquid single-phase refrigerant is decompressed in first decompression unit 7*a* or second decompression unit 7*b*, and turns into gas-liquid two-phase refrigerant. The gas-liquid two-phase refrigerant passes through second pipe C2 and flows through sixth port P6 into the first pipe path of second flow path switching unit 10.

In the fourth state, third on-off valve 13, fourth on-off valve 14, seventh on-off valve 17 and ninth on-off valve 19 are opened, while sixth on-off valve 16 is closed. Thus, a part of the gas-liquid two-phase refrigerant that has flowed into the first pipe path passes through the third pipe path and flows into second distribution unit 3*b*, exchanges heat with outdoor air and evaporates in first outdoor heat exchanger 3, and turns into gas single-phase refrigerant. Another part of the gas-liquid two-phase refrigerant that has flowed into the first pipe path passes through the fourth pipe path and flows into fourth distribution unit 4*b*, exchanges heat with outdoor air and evaporates in second outdoor heat exchanger 4, and turns into gas single-phase refrigerant. The remaining gas-liquid two-phase refrigerant that has flowed into the first pipe path passes through the seventh pipe path and flows into sixth distribution unit 5*b*, exchanges heat with outdoor air and evaporates in third outdoor heat exchanger 5, and turns into gas single-phase refrigerant.

The gas single-phase refrigerant evaporated in first outdoor heat exchanger 3 passes through first distribution unit 3*a*, and flows through second port P2 into the second pipe path. The gas single-phase refrigerant evaporated in second outdoor heat exchanger 4 passes through third distribution unit 4*a*, and flows through third port P3 into the third pipe path. The gas single-phase refrigerant evaporated in third outdoor heat exchanger 5 passes through fifth distribution unit 5*a*, and flows through seventh port P7 into the sixth pipe path. With first on-off valve 11, second on-off valve 12, fifth on-off valve 15 and eighth on-off valve 18 opened and sixth on-off valve 16 closed, the entire gas single-phase refrigerant passes through the first pipe path and flows out through first port P1. The gas single-phase refrigerant that has flowed out through first port P1 is sucked through the suction port of compressor 1.

<Functions and Effects>

According to refrigeration cycle apparatus 101, which has a configuration basically similar to that of refrigeration cycle apparatus 100, effects similar to those of refrigeration cycle apparatus 100 can be provided.

Further, in refrigeration cycle apparatus 101, in the third state, a part of the gas single-phase refrigerant discharged from compressor 1 condenses in first outdoor heat exchanger 3 and turns into gas-liquid two-phase refrigerant of a reduced degree of dryness, and the remaining gas single-phase refrigerant condenses in third outdoor heat exchanger 5 and turns into gas-liquid two-phase refrigerant of a reduced degree of dryness. Then, the gas-liquid two-phase refrigerants join together in second flow path switching unit 20, and the joined refrigerant further condenses in second outdoor heat exchanger 4 and turns into liquid single-phase refrigerant.

Thus, when refrigeration cycle apparatus 101 and refrigeration cycle apparatus 100 have an equal amount of sealed refrigerant, the refrigerant flowing through each of first outdoor heat exchanger 3 and third outdoor heat exchanger 5 when refrigeration cycle apparatus 101 is in the third state has a flow rate lower than that of the refrigerant flowing through first outdoor heat exchanger 3 when refrigeration cycle apparatus 100 is in the third state. Thus, in this case, the gas single-phase refrigerant or gas-liquid two-phase refrigerant flowing through each of first outdoor heat exchanger 3 and third outdoor heat exchanger 5 of refrigeration cycle apparatus 101 has a flow velocity lower than that of the gas single-phase refrigerant or gas-liquid two-phase refrigerant flowing through first outdoor heat exchanger 3 of refrigeration cycle apparatus 100. As a result, the gas single-phase refrigerant or gas-liquid two-phase refrigerant flowing through each of first outdoor heat exchanger 3 and third outdoor heat exchanger 5 when refrigeration cycle apparatus 101 is in the third state has a pressure loss smaller than that of the gas single-phase refrigerant or gas-liquid two-phase refrigerant flowing through first outdoor heat exchanger 3 when refrigeration cycle apparatus 100 is in the third state.

That is, in refrigeration cycle apparatus 101, the flow velocity of the liquid single-phase refrigerant flowing through second outdoor heat exchanger 4 in the third state is raised as in refrigeration cycle apparatus 100, but at the same time, the flow velocity of the gas-liquid two-phase refrigerant flowing through first outdoor heat exchanger 3 and third outdoor heat exchanger 5 in the third state is lowered compared to that of refrigeration cycle apparatus 100. Accordingly, refrigeration cycle apparatus 101 has condensation heat transfer performance during cooling operation still higher than that of refrigeration cycle apparatus 100 during cooling operation.

In addition, the capacity of first outdoor heat exchanger 3 and third outdoor heat exchanger 5 in refrigeration cycle apparatus 101 can be reduced compared to the capacity of first outdoor heat exchanger 3 in refrigeration cycle apparatus 100. The condensation heat transfer performance of refrigeration cycle apparatus 101 during cooling operation can thereby be more finely controlled depending on the cooling load than the condensation heat transfer performance of refrigeration cycle apparatus 100 during cooling operation. A range of air-conditioning load over which refrigeration cycle apparatus 101 can perform cooling operation is wider than a range of air-conditioning load over which refrigeration cycle apparatus 100 can perform cooling operation.

<Modifications>

Although refrigeration cycle apparatuses 100 and 101 each include four-way valve 2 as the first flow path switching unit, this is not restrictive. The first flow path switching unit may have any configuration so long as it is able to switch between the first state and the second state, and may be formed of a plurality of on-off valves, for example.

Refrigeration cycle apparatuses 100 and 101 may each further have any configuration so long as it has the above-described configuration. For example, refrigeration cycle apparatuses 100 and 101 may each include four or more outdoor heat exchangers. In that case, the third state in which three or more outdoor heat exchangers are connected to one another in series may be implemented by second flow path switching units 10 and 20.

Although refrigeration cycle apparatuses 100 and 101 each include relay unit 50, this is not restrictive, and they may not include relay unit 50. Refrigeration cycle apparatuses 100 and 101 may each further include a heat medium circuit through which a heat medium circulates, and the third heat exchanger may be provided as a heat exchanger that exchanges heat between the refrigerant circulating through the refrigerant circuit and the heat medium circulating through the heat medium circuit.

In refrigeration cycle apparatuses 100 and 101, first outdoor heat exchanger 3, second outdoor heat exchanger 4 and third outdoor heat exchanger 5 may each have any configuration so long as it is able to exchange heat between the refrigerant and a heat medium such as air. First outdoor heat exchanger 3 and second outdoor heat exchanger 4 may be configured as a single heat exchanger, for example. First outdoor heat exchanger 3, second outdoor heat exchanger 4 and third outdoor heat exchanger 5 may be configured as a single heat exchanger, for example.

Although the embodiments of the present invention have been described as above, the embodiments described above can be modified in various manners. In addition, the scope of the present invention is not limited to the embodiments described above. The scope of the present invention is defined by the terms of the claims, and is intended to include any modifications within the meaning and scope equivalent to the terms of the claims.

The invention claimed is:

1. A refrigeration cycle apparatus comprising a refrigerant circuit through which refrigerant circulates, the refrigerant circuit including a compressor, a first flow path switching unit, a second flow path switching unit, a first heat exchanger, a second heat exchanger, and a third heat exchanger, the first heat exchanger having a first flow-in/out portion and a second flow-in/out portion to/from which the refrigerant flows in/out, the second heat exchanger having a third flow-in/out portion and a fourth flow-in/out portion to/from which the refrigerant flows in/out, the first flow path switching unit being configured to switch between a first state and a second state, in the first state, at least one of the first heat exchanger and the second heat exchanger being configured to serve as a condenser and the third heat exchanger being configured to serve as an evaporator, in the second state, at least one of the first heat exchanger and the second heat exchanger being configured to serve as an evaporator and the third heat exchanger being configured to serve as a condenser, the second flow path switching unit having a first port, a second port, a third port, a fourth port, a fifth port, and a sixth port through which the refrigerant flows in/out, the first port being connected to a discharge port of the compressor via the first flow path switching unit in the first state, and being connected to a suction port of the compressor via the first flow path switching unit in the second state, the second port being connected to the first flow-in/out portion, the third port being connected to the third flow-in/out portion, the fourth port being connected to the second flow-in/out portion, the fifth port being connected to the fourth flow-in/out portion, the sixth port being connected to the third heat exchanger, the second flow path switching unit being configured to switch between a third state and a fourth state, in the third state, the first port, the second port, the first heat exchanger, the fourth port, the third port, the second heat exchanger, the fifth port and the sixth port being successively connected in series, and in the fourth state, the sixth port, the fourth port, the first heat exchanger, the second port and the first port being successively connected in series, and the sixth port, the fifth port, the second heat exchanger, the third port and the first port being successively connected in series, the second flow path switching unit being configured as a single unit.

2. The refrigeration cycle apparatus according to claim 1, wherein the second flow path switching unit is configured to switch among the third state, the fourth state, a fifth state in which the first port, the second port, the first heat exchanger, the fourth port and the sixth port are successively connected in series, and a sixth state in which the first port, the third port, the second heat exchanger, the fifth port and the sixth port are successively connected in series.

3. The refrigeration cycle apparatus according to claim 2, wherein one of the third state, the fifth state and the sixth state is selected when the refrigeration cycle apparatus is in the first state, and the fourth state is selected when the refrigeration cycle apparatus is in the second state.

4. The refrigeration cycle apparatus according to claim 3, wherein the second flow path switching unit includes a first pipe path connecting the first port to the sixth port, and a second pipe path, a third pipe path, a fourth pipe path and a fifth pipe path that are successively connected to the first pipe path in a direction in which the first pipe path extends from the first port toward the sixth port, the second pipe path connects the second port to the first pipe path, the third pipe path connects the third port to the first pipe path, the fourth pipe path connects the fourth port to the first pipe path, and the fifth pipe path connects the fifth port to the first pipe path, the second flow path switching unit further includes a first on-off valve configured to open and close the second pipe path, a second on-off valve configured to open and close the third pipe path, a third on-off valve configured to open and close the fourth pipe path, a fourth on-off valve configured to open and close the fifth pipe path, a fifth on-off valve configured to open and close a portion located between a first connection portion connected to the second pipe path and a second connection portion connected to the third pipe path in the first pipe path, a sixth on-off valve configured to open and close a portion located between the second connection portion and a third connection portion connected to the fourth pipe path in the first pipe path, and a seventh on-off valve configured to open and close a portion located between the third connection portion and a fourth connection portion connected to the fifth pipe path in the first pipe path, in the third state, the first on-off valve, the second on-off valve, the third on-off valve, the fourth on-off valve and the sixth on-off valve are opened, while the fifth on-off valve and the seventh on-off valve are closed, in the fourth state, the first on-off valve, the second on-off valve, the third on-off valve, the fourth on-off valve, the fifth on-off valve and the seventh on-off valve are opened, while the sixth on-off valve is closed, in the fifth state, the first on-off valve, the third on-off valve and the seventh on-off valve are opened, while the second on-off valve, the fourth on-off valve, the fifth on-off valve and the sixth on-off valve are closed, and in the sixth state, the second on-off valve, the fourth on-off valve, the fifth on-off valve and the seventh on-off valve are opened, while the first on-off valve, the third on-off valve and the sixth on-off valve are closed.

* * * * *